United States Patent [19]

Virr

[11] 4,013,279

[45] Mar. 22, 1977

[54] TREATMENT FURNACE

[75] Inventor: Michael John Virr, Stourbridge, England

[73] Assignee: Fluidfire Development Limited, England

[22] Filed: Aug. 5, 1974

[21] Appl. No.: 495,017

[30] Foreign Application Priority Data

Aug. 9, 1973 United Kingdom ..... 37708/73

[52] U.S. Cl. ..... 266/249

[51] Int. Cl.[2] ..... C21D 1/74

[58] Field of Search ..... 148/16.5; 165/104 F; 266/2 A, 5 R, 5 F, 249, 251, 252; 432/197; 34/57 R, 57 A

[56] References Cited

UNITED STATES PATENTS

| | | | |
|---|---|---|---|
| 3,099,589 | 7/1963 | Tanaka | 148/16.5 X |
| 3,197,346 | 7/1965 | Munday | 148/16.5 |
| 3,336,167 | 8/1967 | Tanaka | 148/16.5 |
| 3,399,874 | 9/1968 | Ritchie | 432/197 |
| 3,921,307 | 11/1975 | Marek et al. | 34/57 A |

*Primary Examiner*—Roy Lake
*Assistant Examiner*—Paul A. Bell
*Attorney, Agent, or Firm*—John C. Smith, Jr.

[57] ABSTRACT

A furnace for heating workpieces in a controlled atmosphere comprises a bed of particles which can be fluidized. The bed is divided by a partition into a treatment zone and a combustion zone. Fuel and air are fed to the combustion zone and burned therein to heat the bed. A treatment gas which provides the required atmosphere is fed to the treatment zone and particles of the bed are permitted to migrate from one zone to the other, thereby carrying heat from the combustion zone to the workpiece in the treatment zone.

4 Claims, 2 Drawing Figures

TREATMENT FURNACE

BACKGROUND TO THE INVENTION

This invention relates to a treatment furnace for heating workpieces in an atmosphere of controlled composition. For example, the invention may be applied to a carburising furnace intended for heating metal workpieces in a carbon-rich atmosphere to carburise the workpieces and to a furnace intended for heating workpieces which are to be hardened in an atmosphere having a carbon potential matching the surface composition of the workpieces.

At the present time, mild steel workpieces are carburised to form a hard case at the outer surface of the workpieces by heating the workpieces in contact with a cyanide compound, in contact with elemental carbon, or in contact with a carbon-rich atmosphere.

The use of solid elemental carbon is not popular, since the process is slow and messy. The cyanide method has the advantage that low capital costs are incurred, but the process gives rise to serious problems concerning disposal of the used cyanide compound and safety of the operatives. Carburising by means of an atmosphere-rich in carbon (gas carburisation) can be carried out relatively quickly and conveniently and can conveniently be carried out as a continuous process rather than a batch process. However, gas carburisation requires the use of a furnace which is arranged to prevent ingress of the ambient atmosphere and also the use of a generator for producing the carbon-rich atmosphere required in the furnace. This equipment is very expensive, compared with that used in the alternative processes and requires a considerable capital investment. There is therefore a requirement for a less expensive apparatus in which gas carburising can conveniently be performed.

SUMMARY OF THE INVENTION

According to the present invention we provide a treatment furnace comprising a bed of refractory particles, inlet means for admitting gases to the bed in such a manner that the gases can fluidise the bed, and feed means for feeding fuel and air through the inlet means to a combustion zone of the bed and for feeding a treatment gas through the inlet means to a treatment zone of the bed.

In a furnace according to the invention, the particles and treatment gas within the treatment zone are heated by heat of combustion released in the combustion zone. Whilst it would be possible to use a separate gas generator to supply the treatment gas for the treatment zone, the use of such a generator can be avoided. In a case where the atmosphere within the treatment zone is required to be an endothermic atmosphere produced by cracking a gaseous fuel, the treatment gas fed into the treatment zone may be the gaseous fuel. This fuel will be heated within the treatment zone and will produce the required atmosphere therein. If required, the treatment gas fed to the treatment zone may be a mixture of a gaseous fuel with some other gas, for example, nitrogen or air.

The furnace may further comprise a partition which lies between the combustion zone and the treatment zone of the bed. By means of such a partition, migration of gases from one zone to the other can be substantially eliminated.

The partition is preferably submerged in the bed, at least whilst the furnace is operating, the arrangement being such that particles can pass from one zone to the other around margins of the partition. Such an arrangement enables particles heated in the combustion zone to migrate to the treatment zone and thereby transfer heat from the combustion zone to the treatment zone.

The partition may be arranged substantially vertically, the lower end of the partition being spaced from the bottom of the bed. This arrangement encourages circulation of particles from one zone, over the partition into the other zone and then below the partition into said one zone.

In a case where the treatment gas consists of or comprises a combustible fuel, the inlet means may comprise a distributor which extends beneath both said zones of the bed and is adapted to distribute throughout the bed gaseous fuel conveyed to the distributor by the feed means, the inlet means further comprising an air inlet for admitting air to the combustion zone only.

The air inlet is preferably disposed above the distributor and above the lower end of the partition.

The distributor may be adapted to distribute the flow of gaseous fuel evenly across the bed. With this arrangement, the addition of air to the combustion zone and the maintenance therein of a temperature somewhat higher than that maintained in the treatment zone will give rise to a much higher gas speed in the combustion zone than occurs in the treatment zone. This difference in gas speeds will promote flow of particles upwardly in the combustion zone, over the upper end of the partition, downwardly in the treatment zone and under the lower end of the partition back to the combustion zone.

Two air inlets may be provided, one being positioned near to the bottom of the bed in the combustion zone, and the other being positioned near to or above the level of the upper end of the partition. It will be understood that at a level above the upper end of the partition, gases from the treatment zone can mix with the gases of the combustion zone so that in a case where the treatment gas consists of or comprises a combustible fuel, this fuel will burn in air supplied by the second air inlet, such combustion taking place near to and above the upper end of the partition.

The combustion zone may surround the treatment zone. For example, the treatment zone may be circular in plan, the combustion zone being annular in shape.

Alternatively, one or both of the treatment zone and the combustion zone may be sub-divided. For example, the bed may comprise three zones arranged side-by-side, the inner zone constituting the treatment zone and the outer zones constituting the combustion zone. When this arrangement is adopted, a conveyor may be provided for conveying workpieces through the treatment zone from one end thereof to the other.

BRIEF DESCRIPTION OF THE DRAWINGS

In the accompanying drawings

DESCRIPTION OF THE PREFERRED EMBODIMENT

Figure 1:
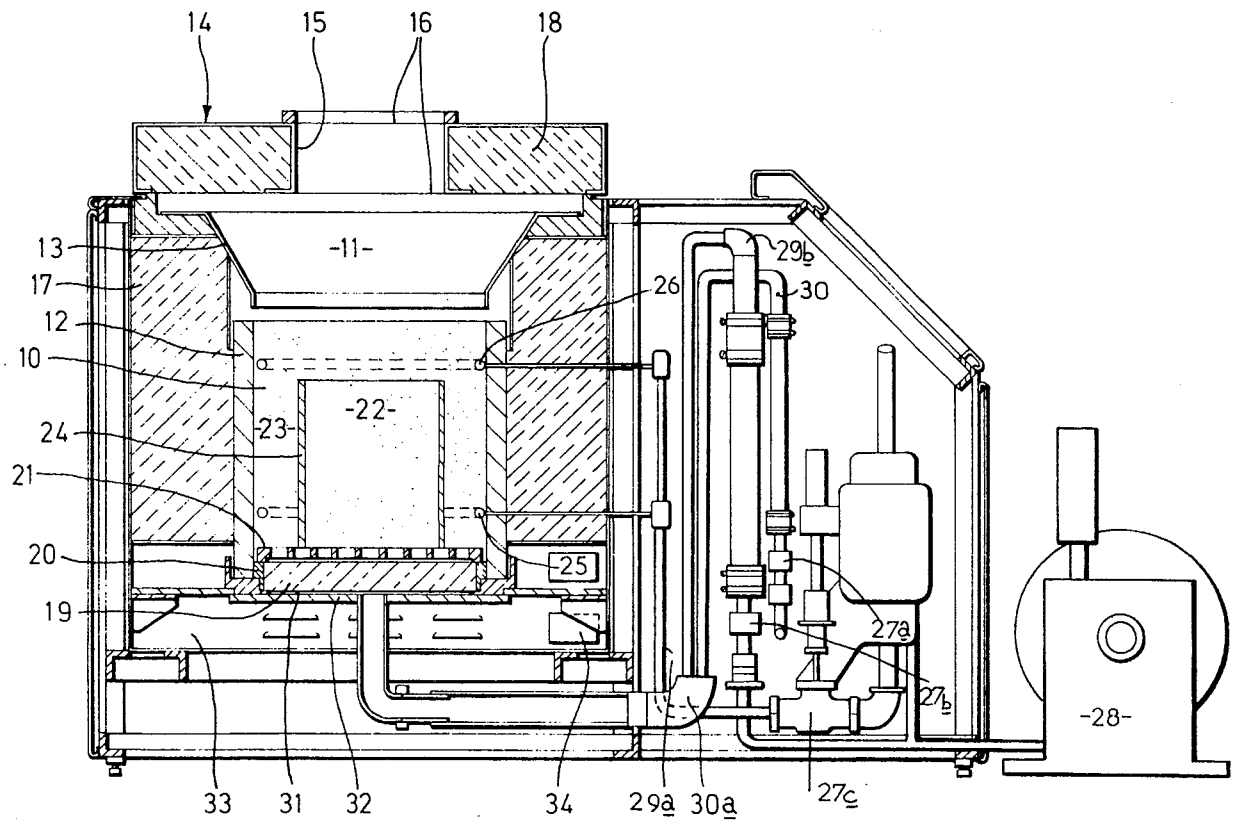
FIG. 1 illustrates in vertical cross-section a treatment furnace according to the invention.

The furnace shown in the accompanying drawing comprises a bed 10 of refractory particles, for example sand, which is contained in a furnace chamber 11. The periphery of the lower part of the furnace chamber is defined by a cylindrical muffle 12 and the periphery of an upper part of the chamber is defined by a frustoconical wall 13 which is upwardly divergent. The upper end of the furnace chamber is normally closed by a hinged lid 14 in which there is formed a central outlet opening 15. The muffle 12 is surrounded by a mass of thermal insulating material 17 and the lid also contains a mass 18 of insulating material.

The furnace further comprises inlet means for admitting gases to the bed 10. The inlet means includes a distributor 19 disposed at the bottom of the furnace chamber 11, the joint between the periphery of the distributor and the lower end of the muffle 12 being sealed by a packing 20. In the particular example shown, the distributor is in the form of a porous ceramic tile, the pores of which are sufficiently small to enable the bed 10 to be supported on the tile. Other forms of inlet means, for example a perforated steel plate, which are pervious to gases but capable of supporting the bed may be used. A horizontal grid 21 disposed within the chamber 11 is spaced slightly above the distributor 19. This grid affords mechanical protection to the distributor in that it prevents any large workpieces which may be dropped into the bed from falling onto the distributor.

The bed 10 is divided into an inner treatment zone 22 and an outer combustion zone 23 by a vertical cylindrical partition 24 which is also disposed within the furnace chamber 11. The lower end of the partition is spaced a short distance above the distributor 19 so that the treatment and combustion zones communicate with one another at a gap between a lower edge of the partition and the bottom of the chamber 11. Since the partition is submerged in the bed, the treatment and combustion zones also communicate with one another through a further gap between the upper edge of the partition and the top of the bed 10.

The inlet means further comprises lower and upper secondary air inlets 25 and 26. These secondary air inlets are both disposed in the combustion zone 23 and are both positioned above the lower end of the partition 24. The lower air inlet 25 is positioned near to the lower end of the partition and the upper air inlet 26 is positioned near to the upper end of the partition 24.

For supplying gaseous fuel and primary air to the distributor 19 and secondary air to the air inlets 25 and 26, feed means including suitable valves 27 and an air blower 28 is provided. The feed means includes an air duct **29*a* which connects the blower with the secondary air inlets 25 and 26, and a further air duct 29*b* which connects the blower with a mixing device 30*a*. The feed means further comprises a gas duct 30 along which gas is fed to the mixing device 30*a* and this mixing device communicates through a feed duct with an inlet chamber 31 disposed immediately beneath the distributor 19. The inlet chamber 31 is defined between the underside of the distributor and a horizontal metal plate 32. The height of the inlet chamber is as small as is consistent with substantially unimpeded flow of the gaseous fuel to all parts of the distributor. Beneath the plate 32 there is a cooling chamber 33 through which air may be blown by a fan 34 to extract heat from the plate 32 and therefore from the gaseous mixture flowing through the inlet chamber 31. In order to avoid the presence of a large volume of the mixture of gaseous fuel and primary air within the apparatus, the mixing device 30*a*** may be situated immediately beneath the cooling chamber.

In operation, a gaseous fuel, for example propane or methane, is fed through the gas duct 30 to the mixing device **30*a* and primary air is mixed with this fuel, the mixture being fed through the distributor 19 into the bed. During normal operation, the proportion of primary air in the mixture is insufficient to oxidise completely the gaseous fuel in the mixture. The distributor is adapted to distribute the mixture of fuel and primary air evenly across the entire bed 10 so that the mixture will pass into both the treatment zone 22 and the combustion zone 23 of the bed. The mixture of gaseous fuel and primary air is supplied at a rate just sufficient to fluidise the treatment zone 22 of the bed. Secondary air is supplied through the inlets 25 and 26** so that combustion of that part of the gaseous fuel which is fed into the combustion zone is completed within that zone.

When the furnace is started from cold, air is fed to the bed 10 through the distributor 19 only and at a rate such that the proportion of primary air mixed with the gaseous fuel is sufficient to complete combustion of the fuel. The mixture of gaseous fuel and air which rises from the bed is ignited near to the surface of the bed. Initially, combustion takes place in a region above but near to the bed and as the particles of the bed become heated the flame strikes back into the bed until combustion is substantially completed within the bed.

When the furnace is operating normally, heat is transmitted from the combustion zone 23 to the treatment zone 22 through the partition 24. Heat is also transferred from the combustion zone to the treatment zone by circulation of particles through the two zones. In consequence of the discharge of air from the secondary air inlet 25 into the combustion zone, and of the somewhat higher temperature which will be established in the combustion zone, as compared with the treatment zone, the upward velocity of gases will be greater in the combustion zone than in the treatment zone. This difference in gas velocity will cause the particles of which the bed 10 is composed to rise in the combustion zone, pass over the upper end of the partition 24, descend through the treatment zone and then pass beneath the lower end of the partition back to the combustion zone. Typically, a temperature within the range 800° to 1,000° C. will be maintained in the treatment zone. At this temperature, hydrocarbon fuels such as methane and propane which are mixed with a sub-stochiometric proportion of air will be cracked, thereby providing carbon to carburise workpieces placed in the treatment zone. The carbon potential of the atmosphere in the treatment zone is determined by the proportion of fuel and air and may be varied between 0.1% carbon and 2.5% carbon for air: gas ratios of 6.5:1 and 4:1 respectively.

Such workpieces would normally be contained within a metal basket which is suspended from the upper end of the furnace chamber 11 so that the workpieces are all disposed within the treatment zone 22. Alternatively, the basket may stand on the grid 21 within the partition 24.

When the furnace is operating normally, air is fed through the secondary air inlets 25 and 26 at a rate such that some of the secondary air mixes with the combustible gases rising from the treatment zone so that combustion of such gases is substantially completed within the furnace chamber 11. Some of the heat released by combustion of gases which pass through the treatment zone is imparted to the particles of the bed 10. As heat released by combustion with air from the lower secondary air inlet 25 is imparted to the particles of the bed more efficiently than heat released by combustion of air from the upper secondary air inlet 26, the temperature within the treatment zone 22 can be controlled by varying the relative rate of feed through the secondary air inlets 25 and 26. A small excess of air is fed through the secondary inlets considered together, to ensure that combustion of all of the fuel fed through the distributor 19 is substantially completed within the furnace chamber.

The case depth achieved, i.e. the thickness of the surface layer of the workpiece into which carbon is introduced, can be varied by varying the period for which the workpieces are maintained in the treatment zone 22 after reaching the temperature of that zone. Typically, a case depth of 20/1000 of an inch can be achieved in a treatment period of 1½ hours duration at a treatment temperature of 950° C, the case comprising 1% to 1.2% carbon.

Figure 2:
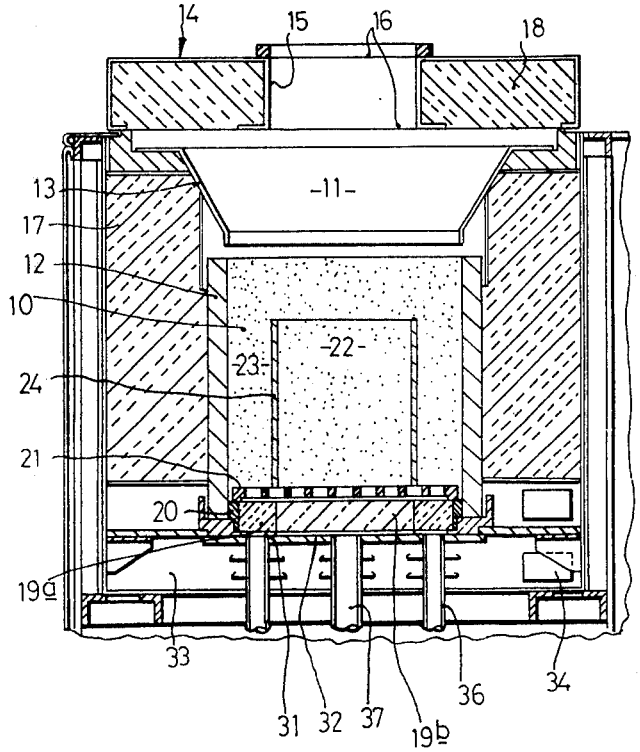
FIG. 2 is a similar view of a part of a treatment furnace illustrating a modification of the furnace shown in FIG. 1.

The treatment gas fed into the treatment zone 22 through the distributor 19 could be substantially pure methane or substantially pure propane, but is preferably a mixture of one of these gases with a sub-stochiometric proportion of air. A treatment gas consisting of such a mixture has a lower carbon potential and results in a less hard case in the workpiece. Use of a mixture of air and a hydrocarbon as the treatment gas has the advantage that the tendency for the treatment gas to give off free carbon upon cracking in the treatment zone is reduced. A mixture of air and hydrocarbon fuel is preferably fed to both the treatment zone 22 and the combustion zone 23 through the distributor. Alternatively, as shown in FIG. 2, two distributors may be provided, one, 19*a* for the combustion zone of the bed, and the other, 19*b*, for the treatment zone the feed means comprising one or more first ducts 36 along which gases are fed to the distributor of the combustion zone and a second duct, 37, along which gases are fed separately to the distributor of the treatment zone. With such an arrangement, a hydrocarbon fuel may be fed to the combustion zone and any selected treatment gas, which may be a single gas or a mixture, may be fed to the treatment zone.

The composition of the atmosphere within the treatment zone may be varied during the treatment of a particular workpiece. For example, the treatment gas fed into the treatment zone through the distributor during an initial period of treatment of a workpiece may be a substantially pure hydro-carbon or a gaseous mixture which provides an atmosphere with a high carbon potential, the surface of the workpiece becoming saturated with carbon during this initial period, and during a subsequent period of treatment of the workpiece a gaseous mixture which provides an atmosphere of lower carbon potential would be supplied to the treatment zone so that during this subsequent period carbon diffuses into the workpiece from the surface thereof but there is little transfer of carbon between the atmosphere and the workpiece.

The furnace may also be used for heat treatment of workpieces other than carburising. For example, the furnace may be used in a hardening process wherein workpieces are heated in an atmosphere having a carbon potential which matches the composition of the workpieces so that there is no substantial transfer of carbon between the atmosphere and the workpiece during the heating. By carrying out the heating in such an atmosphere having a controlled composition, the formation of scale on the workpiece, carburisation of the workpiece and de-carburisation of the workpiece can be reduced or avoided.

The relative quantities of two or more gases fed to the distributor in order to supply a mixture of these gases to the treatment zone may be controlled by manually-settable valves. The feed means may include rotameters or other flow-rate measuring instruments to indicate to an operator the relative quantities of the gases flowing to the distributor.

The partition 24 may form a part of a container for containing workpieces to be immersed in the treatment zone of the bed. In such a case, the partition may constitute an imperforate side wall of the container, the container further comprising a perforate bottom wall through which the fluidising treatment gas and fluidised particles can pass. The upper end of the container would normally be open.

In the particular example of furnace shown in the accompanying drawing, the cylindrical muffle 12 which defines the periphery of the bed has an internal diameter of 13 inches and the partition 24 has an internal diameter of 8 inches. The partition has a height of 9 inches and stands on the grid 21 approximately 1 inch above the distributor 19. The upper surface of the bed is approximately 2 inches above the upper end of the partition when the bed is fluidised.

I claim:

1. A heat treatment furnace comprising:

a. means defining a furnace chamber including a top and a bottom wall;

b. a bed of solid particles contained in the chamber and lying on said bottom wall of the chamber;

c. a vertical, imperforate partition in the chamber separating an outer combustion zone of the bed from a treatment zone of the bed lying within said outer combustion zone, said partition having upper and bottom edges;

d. feed means for feeding fuel to both said outer combustion zone and said treatment zone to fluidize said bed and air inlet means for feeding air to said outer combustion zone above the level of said bottom edge of said partition to cause combustion in said outer combustion zone;

e. said bottom edge of said partition and said bottom wall of said chamber defining therebetween a gap through which said zones communicate; and f. said upper edge of said partition and said top wall of said chamber defining therebetween a further gap through which said zones communicate;

g. whereby, during operation, particles of said bed which have been heated by combustion occurring in said combustion zone are caused to continuously flow upwardly in said outer combustion zone through said further gap between the upper edge of said partition and said top wall from said outer combustion zone to said treatment zone, downwardly through said treatment zone to transfer heat to said treatment zone, and through said gap between said lower edge of said partition and said bottom wall into said outer zone.

2. A treatment furnace according to claim 1 wherein said feed means includes first inlet means for admitting gas to said outer zone, second inlet means for admitting gas to said treatment zone, a first duct leading to said first inlet means and a second duct leading to said second inlet means, whereby gases can be fed separately to said treatment and outer zones respectively.

3. A heat treatment furnace comprising:

a. means defining a furnace chamber including a top and a bottom wall;

b. a bed of solid particles contained in the chamber and lying on said bottom wall of the chamber;

c. an annular, vertical, imperforate partition in the chamber separating an outer combustion zone of the bed from a treatment zone of the bed, said outer combustion zone having an annular configuration surrounding said treatment zone and said partition having upper and bottom edges;

d. feed means for feeding fuel and air to said outer combustion zone of said bed to burn therein to heat and fluidize said outer combustion zone and for feeding a treatment gas to said treatment zone of said bed to fluidize said treatment zone;

e. said bottom edge of said partition and said bottom wall of said chamber defining therebetween a gap through which said zones communicate; and f. said upper edge of said partition and said top wall of said chamber defining therebetween a further gap through which said zones communicate;

g. whereby, during operation, particles of said bed which have been heated by combustion occurring in said combustion zone are caused to continuously flow upwardly in said outer combustion zone through said further gap between said upper edge of said partition and said top wall from said outer combustion zone to said treatment zone, downwardly through said treatment zone to transfer heat to said treatment zone, and through said gap between said lower edge of said partition and said bottom wall into said outer zone.

4. A treatment furnace according to claim 3 wherein said feed means comprises separate means for feeding fuel and air respectively to said outer combustion zone to maintain combustion in said outer combustion zone.

* * * * *